US007481284B2

(12) United States Patent
Wells et al.

(10) Patent No.: US 7,481,284 B2
(45) Date of Patent: Jan. 27, 2009

(54) CONVERGING DIVERGING NOZZLE FOR EARTH-BORING DRILL BITS, METHOD OF SUBSTANTIALLY BIFURCATING A DRILLING FLUID FLOWING THERETHROUGH, AND DRILL BITS SO EQUIPPED

(75) Inventors: Michael R. Wells, Lakewood, CO (US); Chad J. Beuershausen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 226 days.

(21) Appl. No.: 11/336,415

(22) Filed: Jan. 19, 2006

(65) Prior Publication Data

US 2008/0121434 A1 May 29, 2008

Related U.S. Application Data

(60) Provisional application No. 60/646,963, filed on Jan. 25, 2005.

(51) Int. Cl.
*E21B 10/60* (2006.01)

(52) U.S. Cl. ..... 175/393; 175/340; 175/429; 175/424

(58) Field of Classification Search ..... 175/37, 175/429, 340, 424
See application file for complete search history.

(56) References Cited

U.S. PATENT DOCUMENTS 4,076,082 A 2/1978 Baum et al.
4,119,160 A * 10/1978 Summers et al. ..... 175/67
4,190,121 A 2/1980 Baum et al.
4,533,005 A 8/1985 Morris
4,632,216 A 12/1986 Wagner et al.
4,646,977 A 3/1987 Iwamura et al.
4,776,412 A 10/1988 Thompson
4,794,995 A 1/1989 Matson et al.
5,380,068 A 1/1995 Raghavan (Continued)

FOREIGN PATENT DOCUMENTS

EP 0 959 224 A2 11/1999

(Continued)

OTHER PUBLICATIONS

PCT International Search Report mailed May 24, 2006.

*Primary Examiner*—Jennifer H Gay
*Assistant Examiner*—Brad Harcourt
(74) *Attorney, Agent, or Firm*—TraskBritt

(57) ABSTRACT

A nozzle for use on a rotary drill bit for forming a subterranean borehole includes a body and at least one passageway extending through the body from an inlet to an exit aperture. The passageway has a converging region and a diverging region. At least a portion of the diverging region of the fluid passageway is substantially bifurcated. A rotary drill bit for forming a borehole in a subterranean formation includes at least one such nozzle installed within a body of the bit and configured for communicating drilling fluid to a face of the body. A method of communicating fluid to a face of a drill bit includes introducing fluid into a passageway, causing the fluid to flow through a converging region, causing the drilling fluid to flow through a diverging region, and substantially bifurcating the drilling fluid at least within a portion of the diverging region.

56 Claims, 13 Drawing Sheets

U.S. PATENT DOCUMENTS 5,494,124 A 2/1996 Dove et al.
5,632,349 A 5/1997 Dove et al.
5,653,298 A 8/1997 Dove et al.
5,775,443 A * 7/1998 Lott ..... 175/57
5,785,258 A 7/1998 Akin et al.
5,975,431 A * 11/1999 Harita et al. ..... 239/284.1
5,992,763 A 11/1999 Smith et al.
6,186,251 B1 2/2001 Butcher
6,311,793 B1 11/2001 Larsen et al.
6,444,081 B2 9/2002 Ohman et al.
2004/0069534 A1 4/2004 Larsen et al.
2004/0069540 A1 4/2004 Kriesels et al.
2004/0155125 A1 8/2004 Kramer et al.

FOREIGN PATENT DOCUMENTS

WO WO 96/24744 8/1996

* cited by examiner

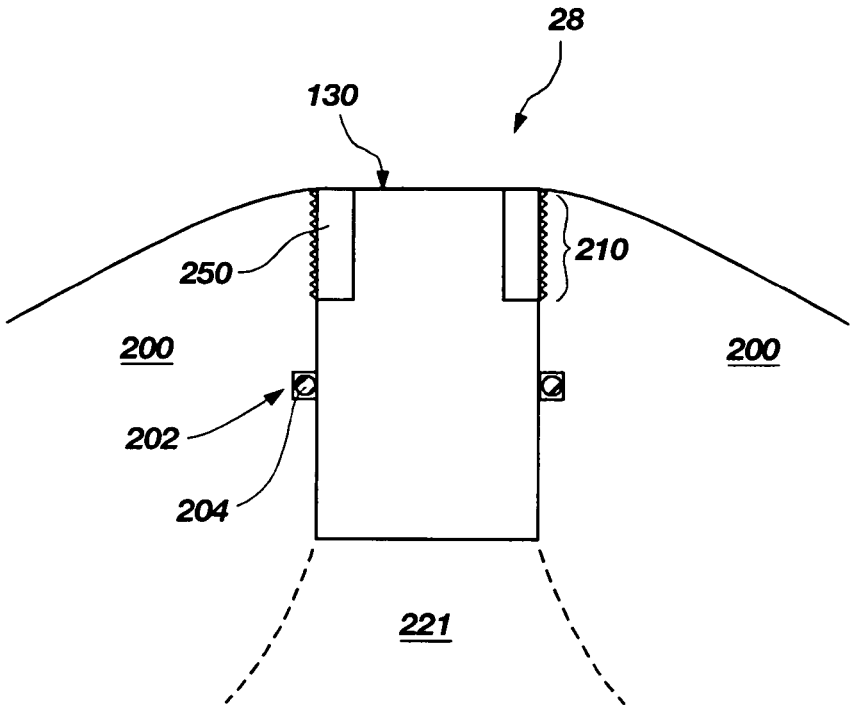
FIG. 2A-A
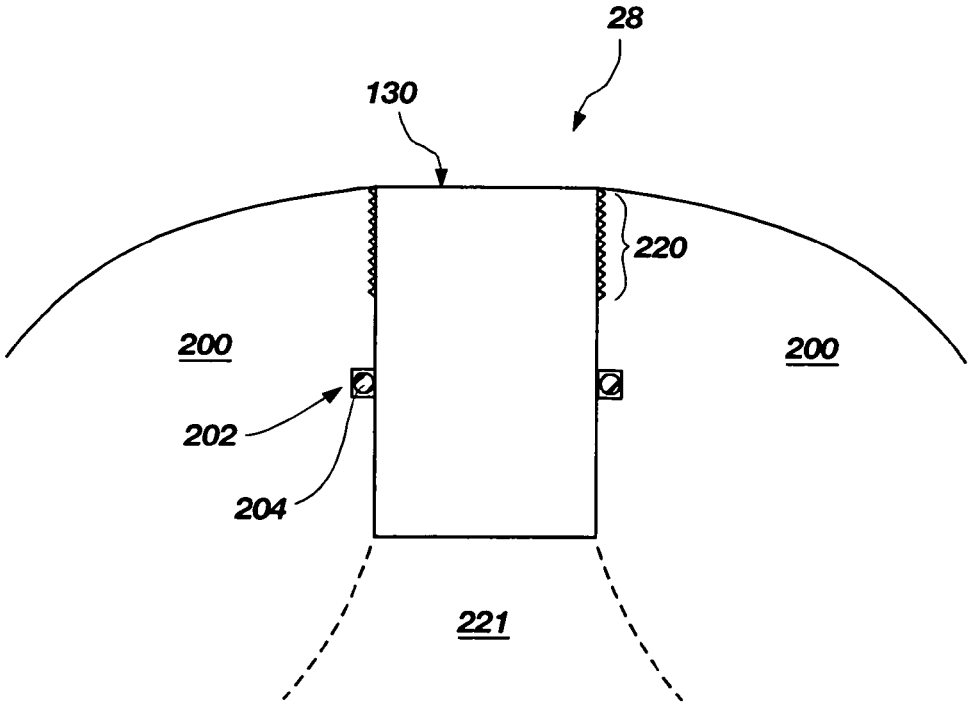
FIG. 2A-B

CONVERGING DIVERGING NOZZLE FOR EARTH-BORING DRILL BITS, METHOD OF SUBSTANTIALLY BIFURCATING A DRILLING FLUID FLOWING THERETHROUGH, AND DRILL BITS SO EQUIPPED

CROSS-REFERENCE TO RELATED APPLICATION

This application claims the benefit of U.S. Provisional Application No. 60/646,963, filed Jan. 25, 2005.

BACKGROUND OF THE INVENTION

1. Field of the Invention

The present invention relates to nozzles for use on subterranean earth-boring rotary drill bits, earth-boring rotary drill bits equipped with such nozzles, and to methods for communicating drilling fluid to a face of an earth-boring rotary drill bit. More particularly, the present invention relates to nozzles exhibiting a converging diverging geometry and having a substantially bifurcated portion of a fluid passageway through the nozzles for directing drilling fluid to different locations on and around earth-boring rotary drill bits equipped with such nozzles.

2. State of the Art

Subterranean drilling operations generally employ a rotary drill bit that is rotated while being advanced through rock formations. Cutting elements or structures affixed to the rotary drill bit cut the rock while drilling fluid removes formation debris and carries it back to the surface. The drilling fluid is pumped from the surface through the drill string and out through one or more (usually a plurality of) nozzles located on the drill bit. The nozzles direct jets or streams of the drilling fluid to clean and cool cutting surfaces of the drill bit and for the aforementioned debris removal.

Because of the importance of the cooling and cleaning functions of the drilling fluid, others in the field have attempted to optimize these benefits by specifically orienting the nozzle exit to direct the drilling fluid to a predetermined location on a cutting surface of the bit. For example, U.S. Pat. No. 4,776,412 to Thompson describes a nozzle assembly designed to resist rotational forces while directing drilling fluid to a predetermined rotational position. The nozzle's internal chamber is preformed to direct the fluid at a specific angle. Likewise, in U.S. Pat. No. 4,794,995 to Matson, et al., a nozzle is disclosed that changes the direction of fluid flow by angling the exit of the nozzle chamber. Again, the angle of exit is predetermined and may only be rotated about its longitudinal axis. U.S. Pat. No. 4,533,005 to Morris is another example of an attempt to provide a nozzle that may be reoriented to provide fluid flow in a specific direction.

Other examples of nozzles for delivering drilling fluids include: U.S. Pat. No. 5,380,068 to Raghaven; U.S. Pat. Nos. 5,494,124, 5,632,349, and 5,653,298 to Dove et al., and U.S. Pat. No. 6,311,793 to Larsen et al. Further, U.S. Patent Application No. 2004/0155125 A1 to Kramer et al. discloses a nozzle having a somewhat oval opening. U.S. Patent Application No. 2004/0069540 A1 to Kriesels discloses high pressure fluid jet nozzles having, in one embodiment, a slotted opening.

The limited ability to control drilling fluid emanating from a nozzle in a desired fashion necessarily limits the potential efficiency of the cleaning and cooling functions of the drilling fluid. Further, since conventional nozzles direct flow of drilling fluid along a single direction or path at a relatively high velocity, impingement of the drilling fluid emanating from a conventional nozzle upon a portion of the drill bit (i.e., a blade or other portion of the body thereof) may cause excessive erosion or wear to occur. Particularly, in the case where a nozzle is designed for providing a single flow stream of drilling fluid toward multiple paths (e.g., two junk slots), excessive erosion and wear may occur on the leading end of the structure(s) (e.g., blade) separating the single flow stream into the multiple paths.

Thus, it would be advantageous to provide a nozzle for use in subterranean earth-boring drill bits which provides suitable cuttings removal impetus, but which reduces undesirable erosion of the drill bit within which the nozzle is installed during use. It would also be advantageous to provide a nozzle design that distributes the drilling fluid emanating therefrom more evenly than conventional nozzle designs.

BRIEF SUMMARY OF THE INVENTION

In one aspect, the present invention includes a nozzle for use on a rotary drill bit for forming a subterranean borehole. The nozzle includes a nozzle body that is configured to be secured within a drill bit. At least one fluid passageway extends through the nozzle body from an inlet to an exit aperture. The fluid passageway has a converging region that extends from a converging region entrance to a throat, and a diverging region that extends from the throat to the exit aperture. The cross-sectional area of the fluid passageway is a minimum at the throat. Moreover, at least a portion of the diverging region of the fluid passageway is substantially bifurcated.

In another aspect, the present invention includes a rotary drill bit for forming a borehole in a subterranean formation. The drill bit includes a bit body having a face, at least one cutting element mounted on the face of the bit body, and at least one nozzle installed within the bit body and configured for communicating drilling fluid from an interior of the bit body to the face of the bit body. The nozzle includes a nozzle body that is configured to be secured within a drill bit. At least one fluid passageway extends through the nozzle body from an inlet to an exit aperture. The fluid passageway has a converging region that extends from a converging region entrance to a throat, and a diverging region that extends from the throat to the exit aperture. The cross-sectional area of the fluid passageway is a minimum at the throat. Moreover, at least a portion of the diverging region of the fluid passageway is substantially bifurcated.

In yet another aspect, the present invention includes a method of communicating drilling fluid to a face of a rotary drill bit for forming a subterranean borehole. A drilling fluid is introduced into a fluid passageway that extends between an inlet disposed within an interior region of a drill bit and an exit aperture disposed at a face of the drill bit. The drilling fluid is caused to flow through a converging region of the fluid passageway from the inlet to a throat region, and caused to flow through a diverging region of the fluid passageway from the throat region to the exit aperture. Furthermore, the drilling fluid is substantially bifurcated at least within a portion of the diverging region of the fluid passageway.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

BRIEF DESCRIPTION OF THE DRAWINGS

FIG. 2A-A is a simplified cross-sectional view of a nozzle of the present invention positioned within a drill bit body;

FIGS. 2A-B is a simplified cross-sectional view of a nozzle of the present invention positioned within a drill bit body;

FIG. 2B shows a perspective view of the passageway of the nozzle shown in FIG. 2A;

FIG. 4A-2 shows a side view of the passageway shown in FIG. 2B, wherein separation features extend within the diverging region and at least a portion of the converging region thereof;

DETAILED DESCRIPTION OF THE INVENTION

Figure 1A:
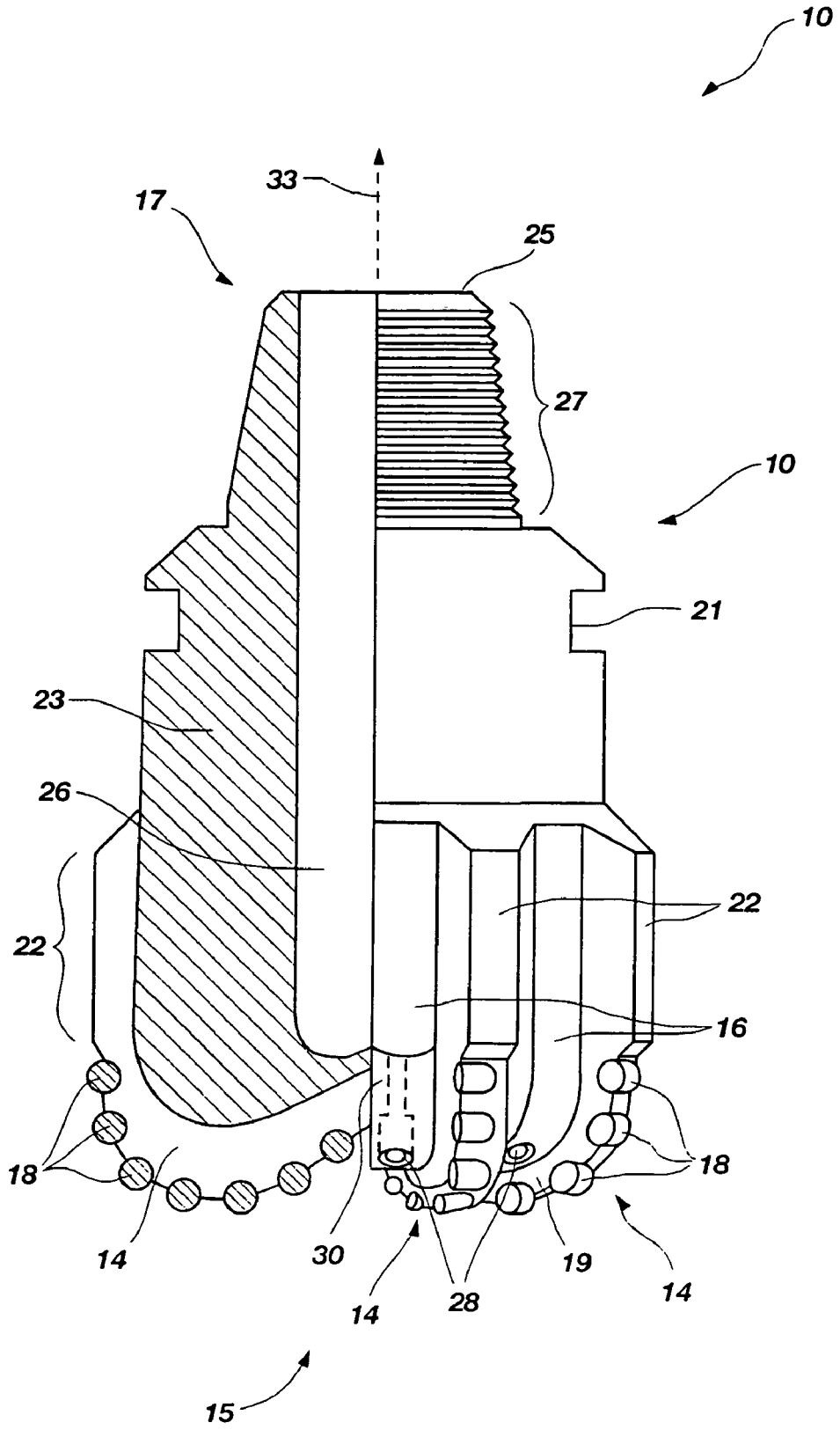
FIG. 1A shows a partially sectioned side view of a rotary drill bit according to the present invention.

Referring to FIG. 1A, an exemplary drag-type rotary drill bit 10 is shown in a partial side and partial side cross-sectional view although the present invention possesses equal utility and applicability in the context of a tricone, or roller cone, rotary drill bit 31 (see FIG. 1C) or other subterranean drilling tools as known in the art which employ nozzles for delivering fluids to a cutting structure during use. Accordingly, as used herein, the term "rotary drill bit" includes and encompasses core bits, roller-cone bits, fixed-cutter bits, impregnated bits, eccentric bits, bicenter bits, reamers, reamer wings, or other earth-boring tools utilizing at least one nozzle for delivery of a drilling fluid as known in the art.

As shown in FIG. 1A, rotary drill bit 10 may generally comprise a bit body 23 including a plurality of longitudinally extending blades 14 defining junk slots 16 therebetween. Each of blades 14 may define a leading or cutting face 19 that extends radially along the bit face around the distal end 15 of the rotary drill bit 10, and may include a plurality of cutting elements 18 affixed thereto for cutting a subterranean formation upon rotation of the rotary drill bit 10. Furthermore, each of blades 14 may include a longitudinally extending gage portion 22 that corresponds to an outermost radial surface of each of blades 14, sized according to approximately the largest-diameter-portion of the rotary drill bit 10 and thus may be typically only slightly smaller, if at all, than the diameter of the borehole intended to be drilled by rotary drill bit 10.

The upper longitudinal end 17 of the rotary drill bit 10, as shown in FIG. 1A, includes a threaded pin 25 including threads 27 for threadedly attaching the rotary drill bit 10 to a drill collar or downhole motor, as is known in the art. In addition, the plenum 26 or bore longitudinally extends within rotary drill bit 10 for communicating drilling fluid therewithin through nozzles 28 disposed on the face of the rotary drill bit 10. Nozzles 28 may comprise nozzles according to the present invention, as discussed in further detail hereinbelow. Threaded pin 25 may be machined directly into the upper longitudinal end 17 of the bit body 23 (i.e., typically a so-called "shank," as known in the art) as may bit breaker surface 21 for loosening and tightening the tapered threaded pin 25 of the rotary drill bit 10 when installed into the drill string.

A plurality of cutting elements 18 is secured to the blades 14 of the rotary drill bit 10 for cutting a subterranean formation as the rotary drill bit 10 is rotated into a subterranean formation. Although FIG. 1A shows two nozzles 28, it should be understood that, more generally, at least one nozzle 28 according to the present invention may be mounted within a drill bit 10 for directing drilling fluid toward at least one desired location at the bottom of the subterranean borehole being cut. For instance, the at least one nozzle 28 may be threadedly secured at an outer surface thereof within a nozzle recess 30 formed in the bit body 23 (having complementarily formed cast or machined threads) and may include a fluid passageway (not shown) through which the drilling fluid is discharged, as described in further detail hereinbelow. Additionally, an annular channel (not shown) in a periphery of nozzle 28 may be adapted to receive or position a sealing element such as, for example, an O-ring between the nozzle recess 30 and the nozzle 28 for sealing therebetween. Thus, during use, a drilling fluid may be communicated through nozzles 28 through plenum 26 in the rotary drill bit 10.

Figure 1B:
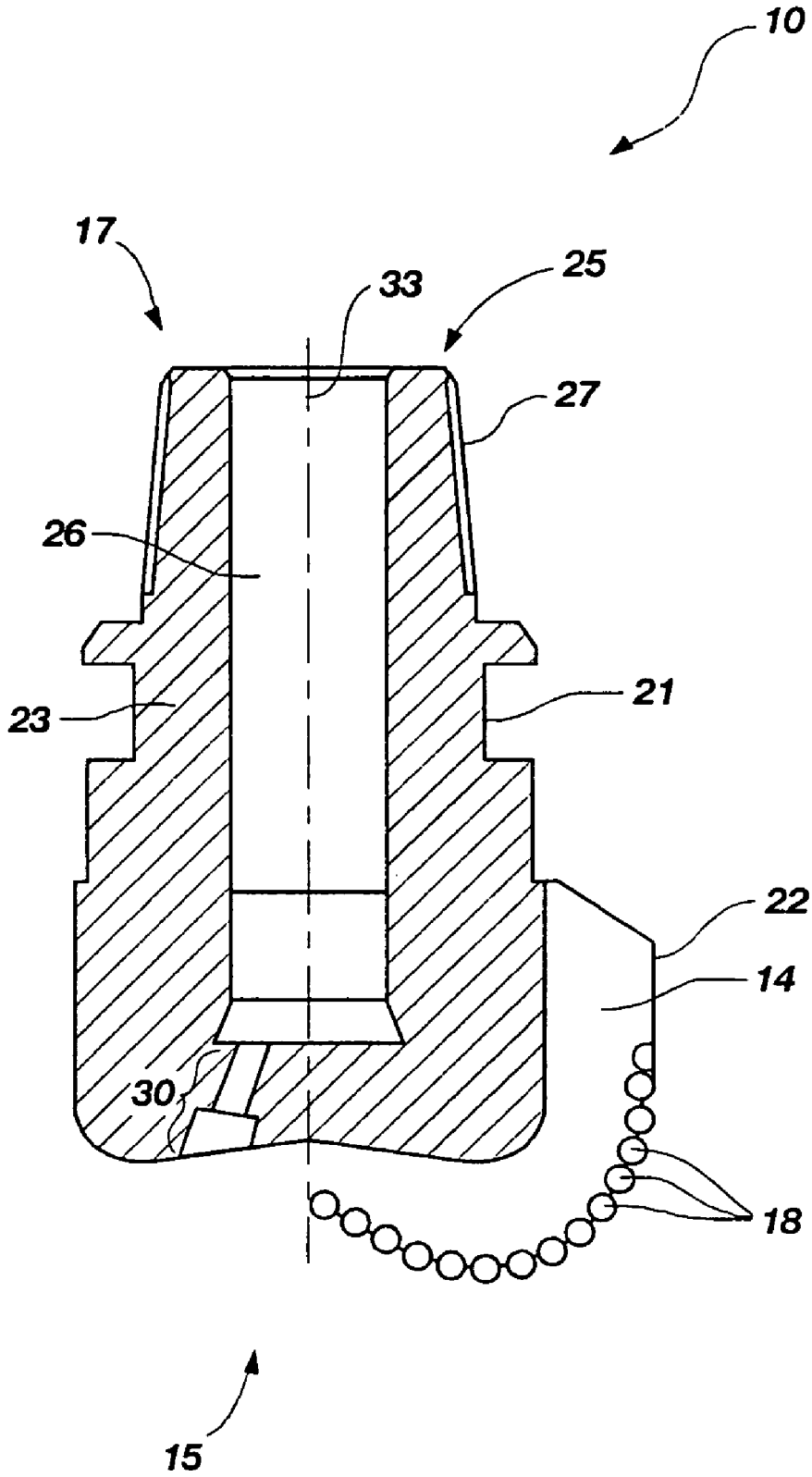
FIG. 1B shows a side cross-sectional view of the rotary drill bit shown in FIG. 1A.
Figure 1C:
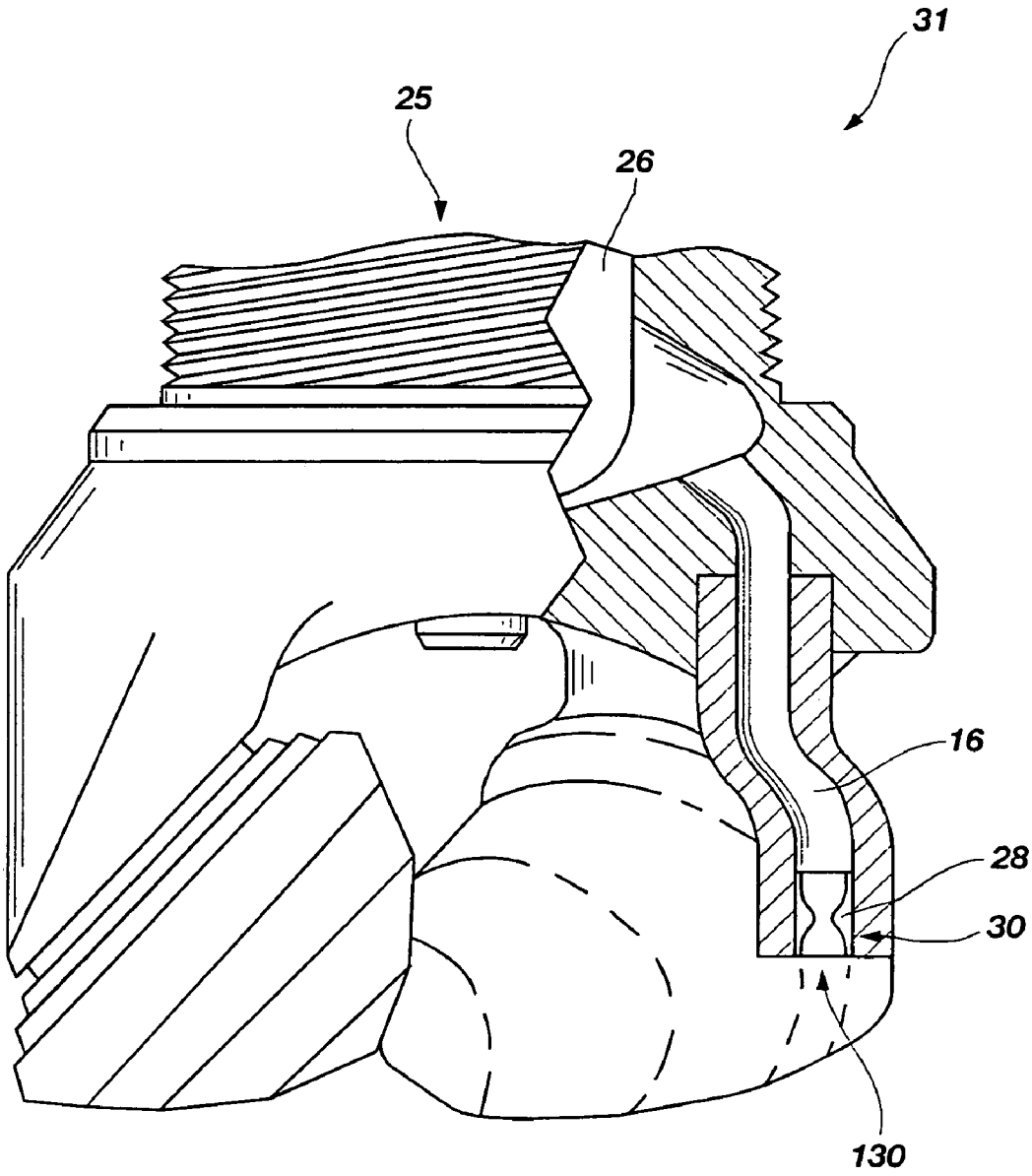
FIG. 1C shows a roller cone type rotary drill bit including a nozzle of the present invention.

For further clarity, FIG. 1B shows a side cross-sectional view of a rotary drill bit 10 about its longitudinal axis 33. More particularly, FIG. 1B illustrates one embodiment of a nozzle recess 30 within rotary drill bit body 23. A nozzle 28 may be preferably removably secured within the nozzle recess 30 by a suitable mechanical affixation mechanism (e.g., threads, pins, retaining rings, etc.) as known in the art. For example, threaded surfaces, sleeves, or retainers may be utilized for affixing nozzle 28 within nozzle recess 30. Alternatively, permanent securement of nozzle 28 within nozzle recess 30 may be effected by way of at least one of brazing, adhesive bonding, or welding.

Generally, drilling fluid is intended for cleaning and cooling the cutting elements 18 and carries formation cuttings to the top of the borehole via the annular space between the drill string and the borehole wall. It will be understood by those of ordinary skill in the art that a bladed-type rotary drill bit 10 may be configured to incorporate the at least one nozzle 28 within one or more blades 14 extending from the bit body 23.

Further, as mentioned above, it should be noted that the present invention exhibits equal utility with all configurations of rotary drilling bits, reamers, or other subterranean drilling tools, without limitation, having blades or otherwise configured, while demonstrating particular utility with rotary drill bits wherein controlled fluid flow is beneficial to the hydraulic performance thereof.

Generally, the present invention contemplates that a nozzle passageway of a nozzle may be configured for substantially bifurcating a flow of drilling fluid passing therethrough. As used herein "substantially bifurcating" a drilling fluid flow means that two substantially distinct drilling fluid flows are formed from an incoming drilling fluid flow, wherein each of the two substantially distinct drilling fluid flows include at least about 25% of the incoming drilling fluid flow. Such a configuration may more evenly distribute (spatially) drilling fluid passing through a nozzle according to the present invention in comparison to a conventional nozzle. As another advantage, substantially bifurcating a flow of drilling fluid through a nozzle may also reduce erosion of a portion of a bit body or a portion of a bit blade along the nozzle axis (i.e., in the direction of exiting fluid flow) which may otherwise occur in response to drilling fluid impingement from a conventionally configured nozzle.

Figure 2A:
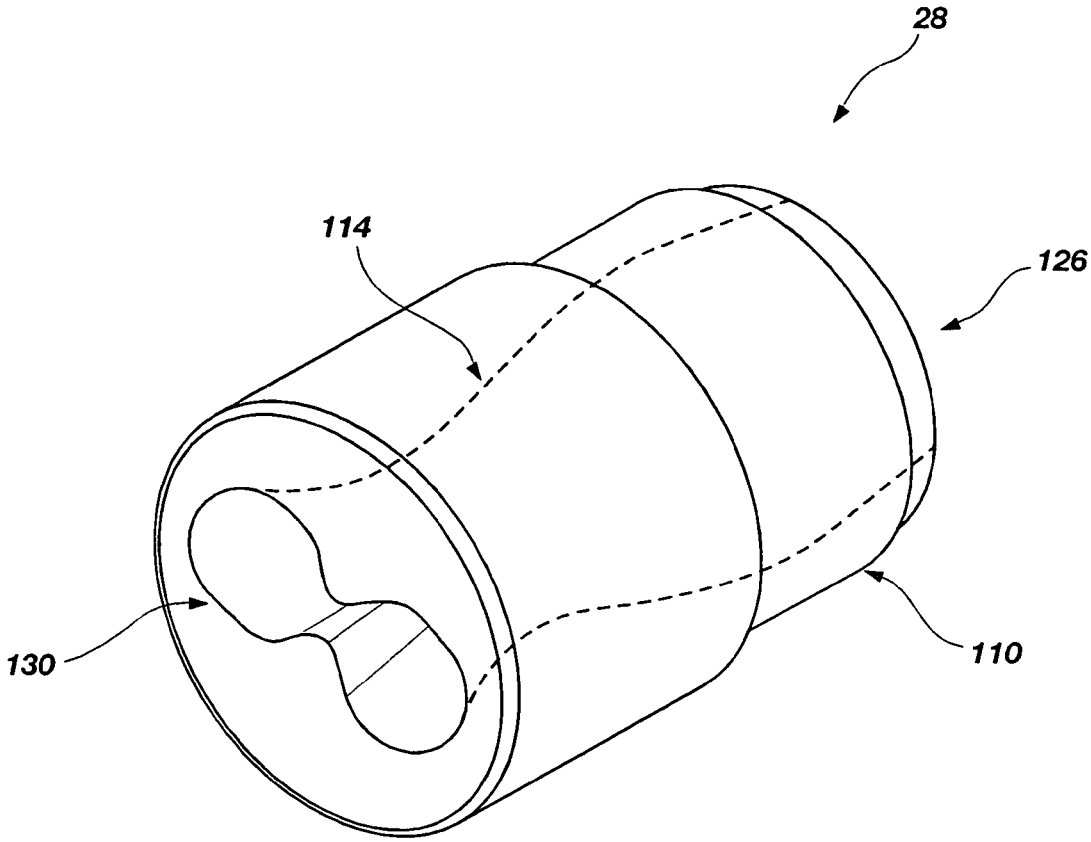
FIG. 2A shows a perspective view of a nozzle according to the present invention.

A nozzle of the present invention will now be described. Particularly, FIG. 2A shows a perspective view of a nozzle 28 according to the present invention. As shown in FIG. 2A, a nozzle 28 of the present invention may comprise a nozzle body 110 having at least a portion thereof configured for securing the nozzle body 110 within a nozzle recess (e.g., nozzle recesses 30 as shown in FIGS. 1A and 1B) of a rotary drill bit. In general, nozzle 28 includes a passageway 114 defined by an interior of nozzle body 110 that extends between an inlet 126 and an exit aperture 130. Thus, as may be appreciated, in a drilling fluid environment, a pressure differential (i.e., higher to lower) between a fluid proximate inlet 126 and a fluid proximate exit aperture 130 may cause fluid to flow through passageway 114 from inlet 126 toward exit aperture 130.

More particularly, nozzle 28 is defined by a nozzle body 110, an interior of which defines passageway 114 extending between an inlet 126 and an exit aperture 130. Passageway 114 may be generally configured for communicating a drilling fluid that passes into inlet 126 through passageway 114 and exits nozzle body 110 at exit aperture 130. Further, nozzle body 110 may be configured for resisting erosion due to drilling fluid passing through passageway 114. For example, nozzle body 110 may comprise a ceramic, a cermet, or another relatively hard, erosion resistant material as known in the art. In one embodiment, nozzle body 110 may comprise a cobalt-cemented tungsten carbide. Such a configuration may be resistant to the abrasive and erosive effects of drilling fluid during a drilling operation. In another embodiment, nozzle body 110 may be formed of, for example, steel which is lined with an abrasion and erosion-resistant material such as tungsten carbide, diamond, ceramics, hardfacing, or polyurethanes.

Figure 2B:
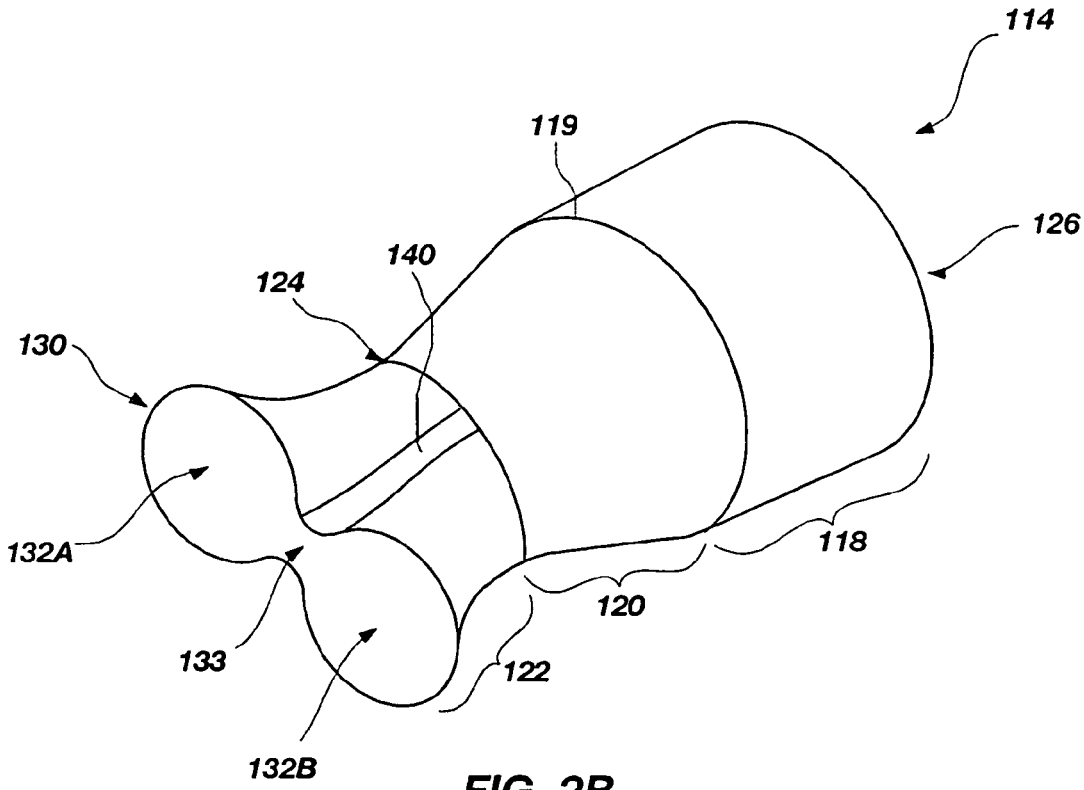

Furthermore, nozzle body 110 may be configured for securement within a rotary drill bit. For instance, nozzle body 110 may include a threaded surface for engaging a complementarily shaped threaded surface that is formed within a drill bit (not shown). Further, nozzle body 110 may include an annular channel (not shown) in a periphery thereof that is adapted for receiving a sealing element such as, for example, an O-ring for sealing between a nozzle recess (e.g., nozzle recess 30 as shown in FIGS. 1A and 1B) formed in a rotary drill bit and the nozzle body 110. In further detail, FIGS. 2A-A and FIG. 2A-B, show two embodiments for attaching nozzle body 110 to a drill body 200. Particularly, FIG. 2A-A shows a simplified cross-sectional view of a nozzle 28 installed within a bit body 200, wherein a retaining ring 250 is attached to the bit body 200 along an attachment region 210. Retaining ring 250 may be attached to the bit body 200 by way of a threaded surface, a braze, welding, pins, or as otherwise known in the art. Similarly, FIG. 2A-B shows a simplified cross-sectional view of a nozzle 28 installed within a bit body 200, wherein the nozzle 28 is one-piece and includes an attachment region 220 for attachment to the bit body 200. As shown in FIGS. 2A-A and 2A-B, a cavity 202 may be formed in the bit body 200 for accepting a sealing element 204(e.g., an 0-ring) for sealing between the bit body 200 and the nozzle 28. Also, conduit 221 formed in the bit body may be configured for conducting drilling fluid to the nozzle 28.

Figure 5A:
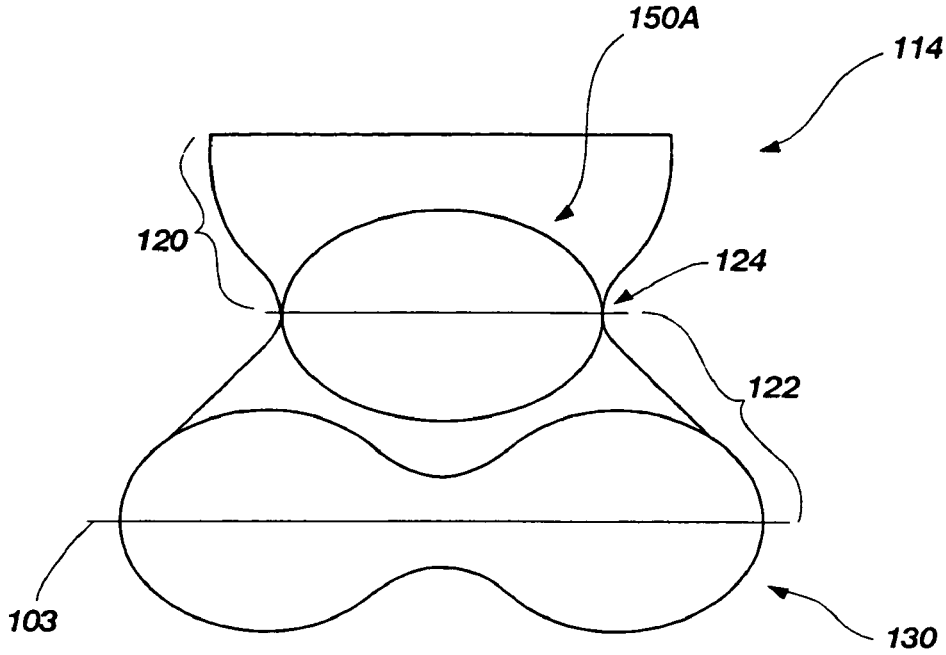
FIGS. 5A and 5B are partial conceptual views showing different geometries of a portion of a converging region and an exit aperture of a passageway according to the present invention.

It may be further appreciated, that the orientation of a nozzle according to the present invention may be important since a substantially bifurcated flow therefrom may be directed according to the orientation of the nozzle. Therefore, the present invention contemplates that the nozzle may be configured for attachment to a drill bit at a selected orientation. In an embodiment wherein the nozzle includes a threaded surface for attachment to a drill bit body, accuracies of at least about ±2° (e.g., orientation of an axis such as horizontal axis 103 as shown in FIG. 5A, with respect to a desired or selected orientation) may be achieved. Further, at least one mark or indicium formed on the nozzle may indicate an orientation of the nozzle. For instance, at least one mark or indicium may indicate an axis about which a flow through the nozzle is bifurcated. Such a configuration may allow for selective orientation of a flow through a nozzle of the present invention, which may be desirable when a nozzle of the present invention is installed within a drill bit, as discussed in further detail hereinbelow.

In further detail, fluid passageway 114 formed within the nozzle body 110, as shown in FIG. 2B, may be generally described as including a diverging-converging geometry wherein at least a portion of the diverging geometry is configured for substantially bifurcating or dividing drilling fluid passing therethrough. FIG. 2B shows a perspective view of passageway 114 including inlet region 118, converging region 120 extending to throat 124, and diverging region 122 extending from throat 124 to exit aperture 130. As known in the art, converging-diverging nozzle geometries may also be known as "venturi" nozzle geometries. As shown in FIG. 2B, inlet 126 may have a substantially constant or unchanging shape within inlet region 118. For example, inlet 126 as well as inlet region 118 may be substantially circular, substantially elliptical, substantially rectangular, substantially triangular, or cross-sectionally shaped as otherwise desired or known in the art.

Within converging region 120, the area of passageway 114 may generally decrease in the direction of flow therethrough to throat 124. Optionally, the shape of inlet region 118, at entrance 119 of converging region 120, may be substantially retained in a direction toward throat 124, if desired. Throat 124 is a portion of passageway 114 substantially transverse to the flow of fluid therethrough defining a minimum area thereof. In one embodiment, throat 124 may comprise an oblong shape derived from two $^{11}/_{32}$ diameter circles that at least partially overlap with one another. More generally, throat 124 may comprise an oblong shape derived from two circles having a diameter between about $^{8}/_{32}$ of an inch and $^{16}/_{32}$ of an inch that may at least partially overlap with one another. In addition, throat 124 may contain circles having a diameter between about $^{8}/_{32}$ of an inch and $^{16}/_{32}$ of an inch that may be separated by an arbitrary finite distance. Of course, the size and shape of the throat 124 may exhibit various shapes (oval, elliptical, rectangular, triangular, etc.) and sizes as desired. In turn, the configuration of a nozzle body 110 may be adjusted in relation to the throat structure and the size and shape of a cavity within a drill bit for positioning a nozzle of the present invention therein may correspondingly be adjusted in relation to the nozzle body 110.

Further, as shown in FIG. 2B, diverging region 122 may extend from throat 124 toward exit aperture and may include at least one flow separation feature 140 extending generally from throat 124 to exit aperture 130. Flow separation feature 140 may be configured for at least partially separating a flow of drilling fluid through passageway 114 into two distinct flows. In addition, it should be noted that while the embodiments shown herein generally include two flow separation features 140, the present invention contemplates that at least one flow separation feature 140 may be configured for at least partially separating a flow of drilling fluid through passageway 114 into two distinct flows, without limitation. Thus, as shown in FIG. 2B, diverging region 122 may comprise enlarged conduits 132A and 132B communicative with one another by a narrow conduit 133. Such a configuration may substantially bifurcate or divide a flow of drilling fluid passing through diverging region 122 of passageway 114.

That is, drilling fluid flowing through passageway 114 may pass through inlet region 118, into converging region 120 (which may accelerate such drilling fluid), further into throat 124, and through diverging region 122 wherein two substantially distinct flows or streams may be developed within enlarged conduits 132A, 132B. Of course, drilling fluid may flow within narrow conduit 133 and may be communicated between enlarged conduits 132A, 132B therethrough.

Figure 2C:
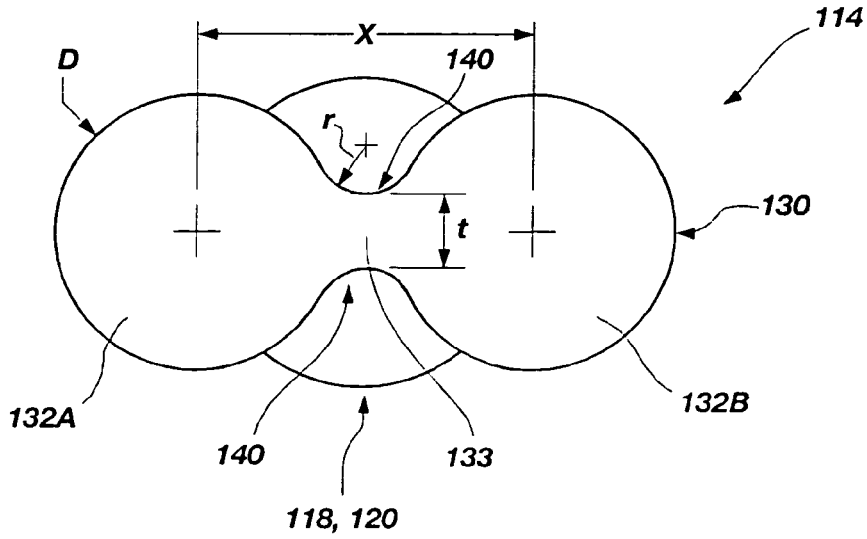
FIG. 2C shows a front view of the passageway shown in FIG. 2B, as if the viewer were looking into the exit aperture thereof.

As may be appreciated, many variations of the geometry shown in FIG. 2B are encompassed by the present invention. For instance, FIG. 2C shows a front view of passageway 114 as if the viewer were looking into exit aperture 130. As shown in FIG. 2C exit aperture 130 may include two generally rounded areas defined by enlarged conduits 132A and 132B, respectively, and the centers of which are separated by a distance X. In one embodiment, exit aperture 130 may include substantially circular portions thereof that each exhibits a diameter D. Alternatively, portions of exit aperture 130 may be substantially elliptical, substantially oval, substantially oblong, generally arcuate, straight, or as otherwise may be desired, without limitation. Diameter D may be selected as desired, without limitation. For example, diameter D may be between about 4/32 of an inch and about 1 inch, without limitation.

Also, as shown in FIG. 2C, exit aperture 130 includes two flow separation features 140 wherein flow separation features 140 comprise smooth radiuses or fillets extending between each of enlarged conduits 132A and 132B and having a radius R. Furthermore, each of enlarged conduits 132A and 132B may be connected to one another by narrow conduit 133 defined between flow separation features 140, separated by distance T. Distance T may be selected as desired, without limitation. For example, distance T may be between about 0.0 inch and about 0.5 of an inch, without limitation. Alternatively, flow separation features 140 may actually, at some position within passageway 114, completely separate enlarged conduit 132A from enlarged conduit 132B.

As may be appreciated, with reference to FIG. 2B, the geometry of exit aperture 130 may be generally exhibited or maintained within diverging region 122. Of course, within diverging region 122 the geometry of exit aperture 130 may smoothly transition from a smaller substantially identical geometry proximate to or generally at throat 124 in relation to a selected diverging shape function. Accordingly, diameter D and distance X may substantially continuously decrease in a direction from exit aperture 130 toward throat 124.

Conversely, distance T may substantially continuously decrease (i.e., pinching between a drilling fluid flow between enlarged conduits 132A and 132B) in a direction from throat 124 toward exit aperture 130 or, alternatively, may exhibit an intermediate transitional or constant geometry therebetween. Such a configuration may advantageously inhibit or reduce a level of particle erosion due to drilling fluid passing through narrow conduit 133, since particle erosion may depend, at least in part, upon relatively high velocity fluid flow and impingement thereof upon a surface.

Summarizing, the geometry of exit aperture 130, notwithstanding flow separation features 140, may be substantially congruent to a geometry exhibited generally at or proximate to throat 124, wherein the diverging region 122 comprises a substantially continuous transition therebetween. Thus, it may be appreciated that enlarged conduits 132A and 132B may be related to the geometry exhibited by exit aperture 130.

Figure 3A:
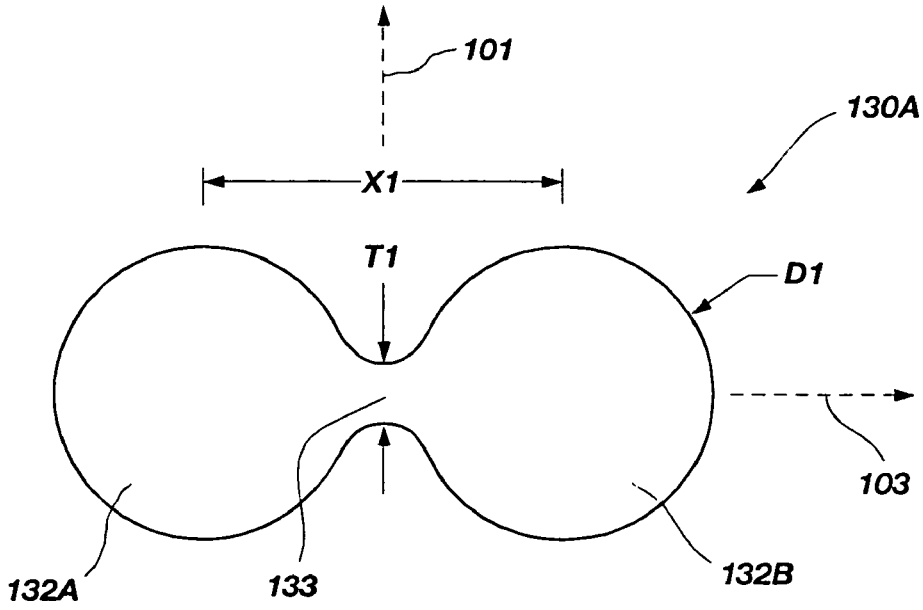
FIGS. 3A-3D show schematic front views of different embodiments of an exit aperture of a passageway as shown in FIGS. 2B and 2C.

Accordingly, the present invention contemplates a wide variety of geometries for exit aperture 130 (FIGS. 2B and 2C). For example, FIGS. 3A-3D illustrate exemplary embodiments of exit apertures 130A-130D. Particularly, FIG. 3A shows exit aperture 130A including rounded areas defined by enlarged conduits 132A and 132B in exhibiting a diameter D1 wherein each of the centers of the enlarged conduits 132A and 132B are separated by a distance X1. Furthermore, flow separation features 140 may form generally rounded fillets extending between enhanced conduits 132A and 132B that further define narrow conduit 133 having a thickness T1. As shown in FIG. 3A, enlarged conduits 132A and 132B as well as narrow conduit 133 may each be substantially symmetrical about vertical axis 101 and horizontal axis 103. Alternatively, at least one of enlarged conduit 132A, enlarged conduit 132B, and narrow conduit 133 may be unsymmetrical about at least one of vertical axis 101 and horizontal axis 103.

Figure 3B:
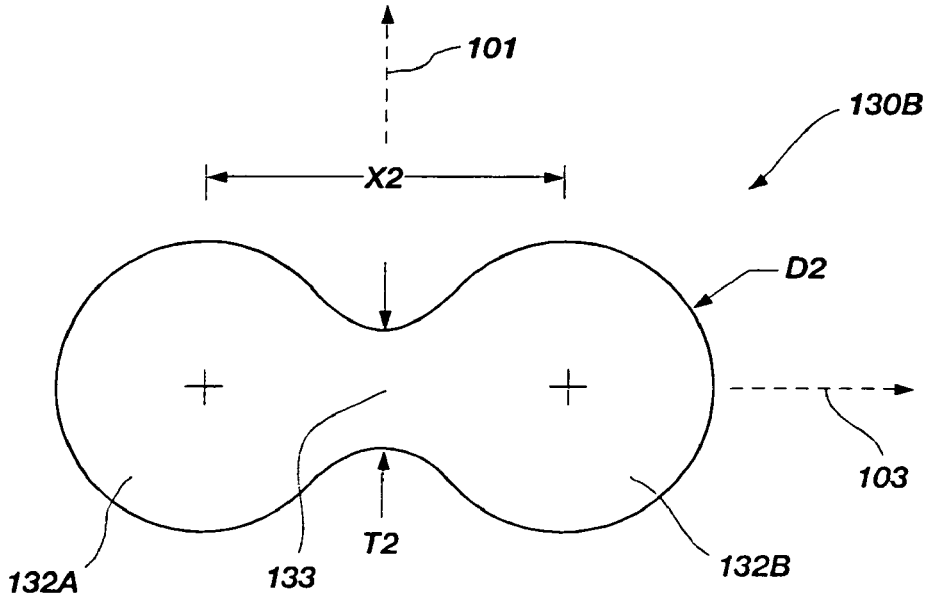

FIG. 3B shows exit aperture 130B including rounded areas defined by enlarged conduits 132A and 132B in exhibiting a diameter D2 wherein each of the centers of the enlarged conduits 132A and 132B are separated by a distance X2. Also, as shown in FIG. 3B, narrow conduit 133 may be asymmetrical about horizontal axis 103. In addition, narrow conduit 133 may exhibit a thickness T2 which provides a relatively ample (compared to thickness T, as shown in FIG. 3A) communication between enhanced conduits 132A and 132B. Selecting characteristics of the flow separation features 140 may provide the ability to adjust or tailor at least one of the respective fluid jets which flow from exit aperture 130B during use of the nozzle associated therewith. It may be further noted that exit aperture 130B, as shown in FIG. 3B, is substantially symmetric about vertical axis 101.

Figure 3C:
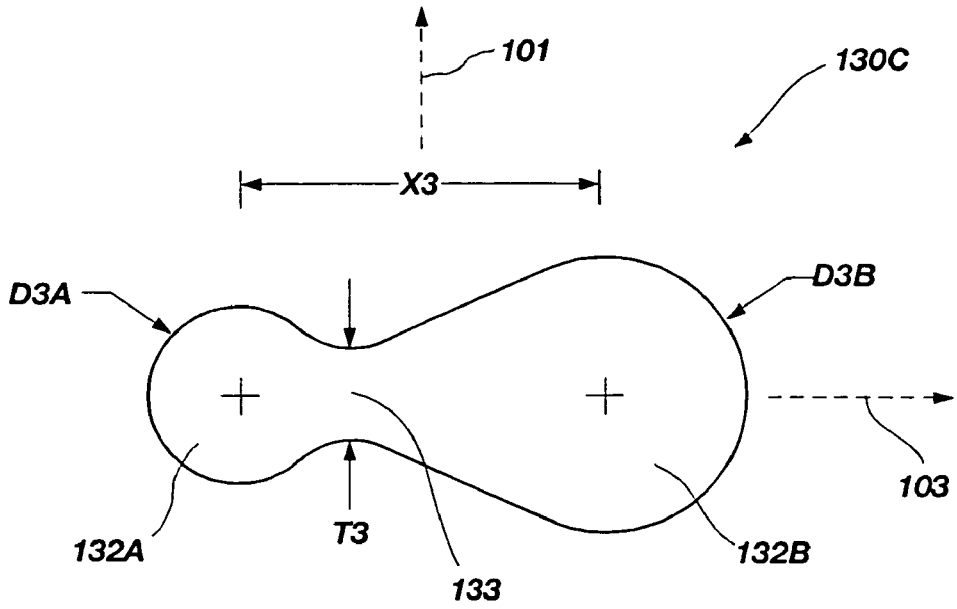

In another embodiment, FIG. 3C shows exit aperture 130C including rounded areas defined by enlarged conduits 132A and 132B in exhibiting diameters D3A and D3B, respectively, wherein each of the centers of the enlarged conduits 132A and 132B are separated by a distance X3. Also, as shown in FIG. 3C, narrow conduit 133 may be positioned asymmetrically with respect to vertical axis 101 (i.e., not centered between the centers of enlarged conduits 132A and 132B). Accordingly, FIG. 3C shows exit aperture 130C including enlarged conduits 132A and 132B, wherein enlarged conduits 132A and 132B are unsymmetrical with respect to vertical axis 101. Such a configuration may allow for a greater flow rate of drilling fluid through enlarged conduit 132B in relation to a flow rate of drilling fluid through enlarged conduit 132A. Of course, it may be appreciated that selecting characteristics of the enlarged conduits 132A and 132B may provide the ability to adjust or tailor at least one of the respective fluid jets which flow from exit aperture 130C during use of the nozzle associated therewith.

Figure 3D:
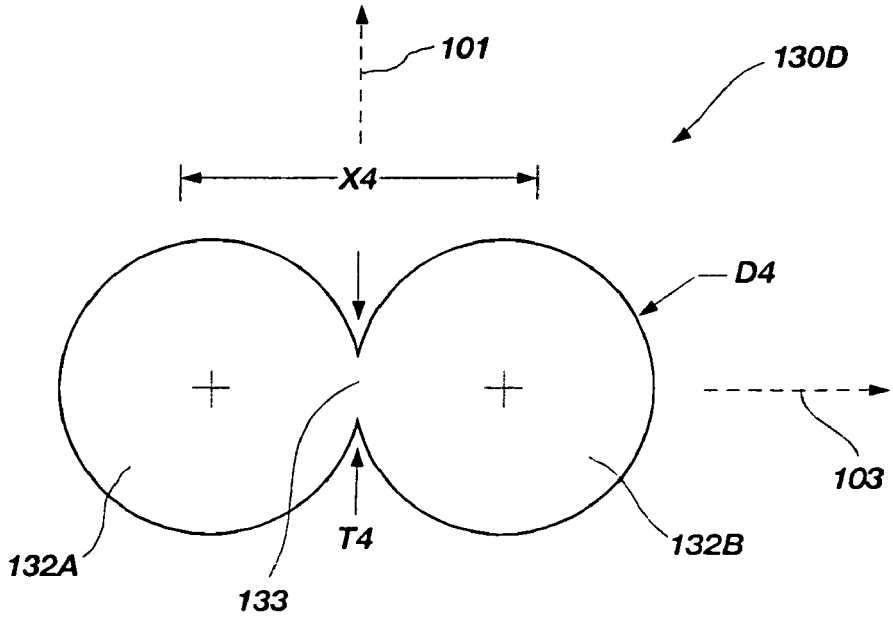

In yet another embodiment of exit aperture 130, FIG. 3D shows exit aperture 130D including rounded areas defined by enlarged conduits 132A and 132B each exhibiting a diameter D4 wherein each of the centers of the enlarged conduits 132A and 132B are separated by a distance X4. More particularly, FIG. 3D shows enlarged conduits 132A and 132B wherein each exhibits a substantially circular shape. In addition, as shown in FIG. 3D, narrow conduit 133 exhibits a thickness T4 and is formed by the intersection of substantially circular enlarged conduits 132A and 132B.

It should be understood that although the above embodiments depict enlarged conduits 132A and 132B as having generally rounded features, the present invention is not so limited. Rather, the present invention contemplates that the geometry of enlarged conduits 132A and 132B may be substantially circular, substantially elliptical, substantially oval, substantially oblong, substantially rectangular, substantially triangular, or as otherwise desired or known in the art. Accordingly, as may be appreciated with respect to the above discussion, many alternative configurations are encompassed by the present invention.

Figures 1, 4A:
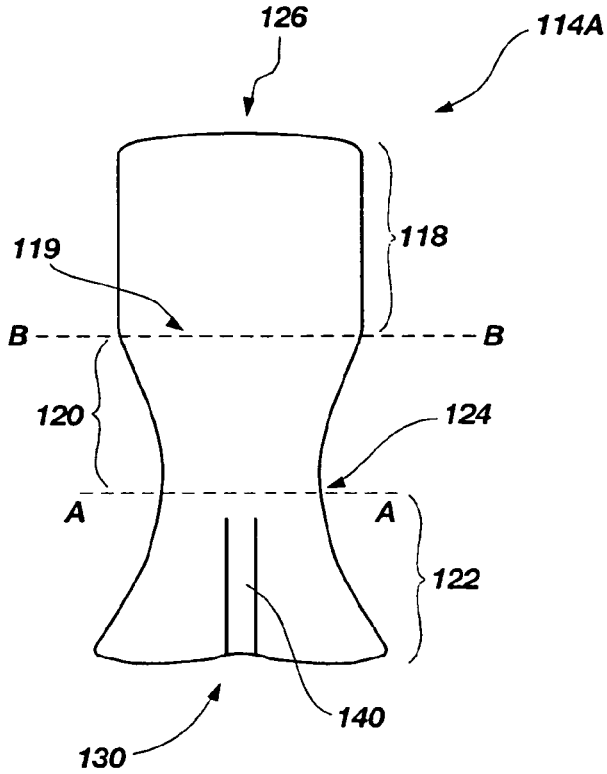
FIG. 4A-1 shows a side view of the passageway shown in FIG. 2B, wherein separation features extend within a portion of the diverging region thereof.
Figures 2, 4A:
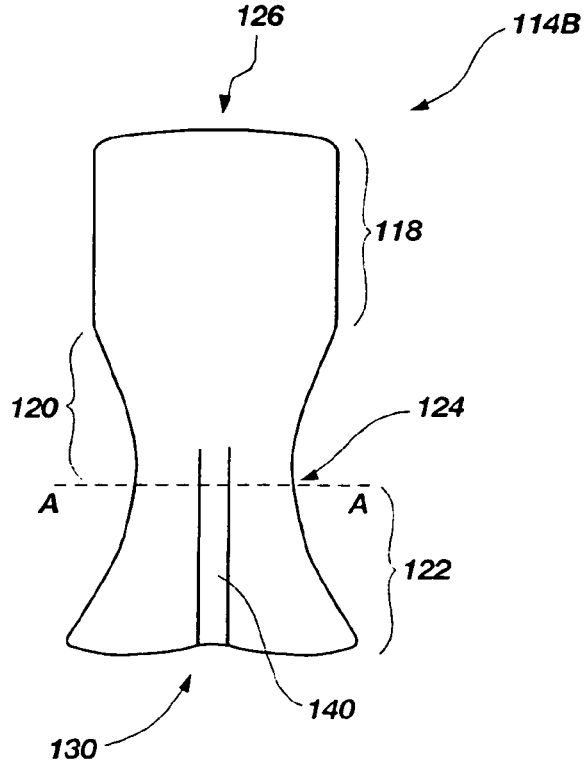

Similarly, the present invention contemplates numerous embodiments of passageway 114. In one consideration, substantial bifurcation may occur solely within a portion of a diverging region 122 of passageway 114, or within at least a portion of converging region 120 as well. For example, in one embodiment of passageway 114A, as shown in FIG. 4A-1, flow separation features 140 may extend from exit aperture 130 generally toward throat 124 and within at least a portion of diverging region 122. Of course, the size, shape, and configuration of flow separation features 140 may be selected for influencing a characteristic of drilling fluid passing through passageway 114A. In another embodiment, optionally, as shown in FIG. 4A-2, passageway 114B may include flow separation features 140 extending at least partially within converging region 120.

Figure 4B:
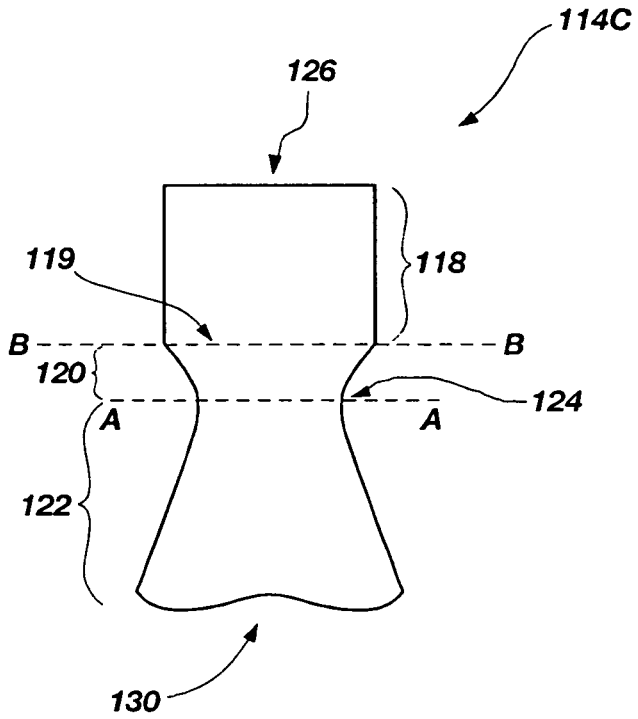
FIGS. 4B-4C show side views of different embodiments of a passageway as shown in FIGS. 2B and 2C.
Figure 4C:
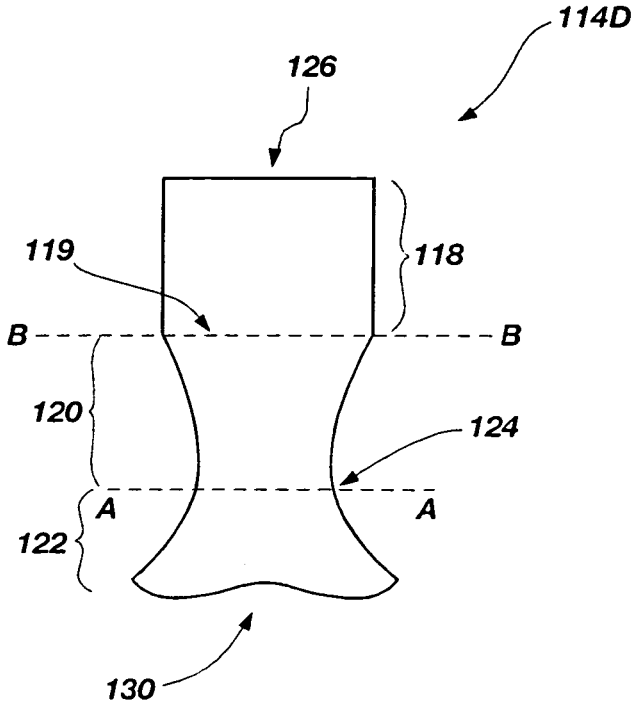

The present invention also contemplates various configurations related to the size, shape, and position of a converging region 120 and a diverging region 122 of passageway 114. For instance, FIGS. 4A-1 and 4A-2 show side schematic views of passageway 114 wherein throat 124 is positioned substantially centrally between entrance 119 of converging region 120, depicted by reference line B-B, and exit aperture 130. Selecting a position of throat 124 (depicted by reference line A-A) may be advantageous for influencing at least one characteristic of at least one or both of the bifurcated (i.e., substantially distinct) drilling fluid jets or flows exiting the exit aperture 130 of the passageway 114. In an alternative embodiment, FIG. 4B shows passageway 114C wherein throat 124 is located proximate to entrance 119 of converging region 120. Alternatively, in yet a further alternative embodiment, FIG. 4C shows passageway 114D wherein throat 124 is positioned proximate exit aperture 130.

More generally, the present invention contemplates that a configuration (i.e., size, orientation, position, shape, etc.) of the converging region, the throat, the diverging region, and the flow separation features may be selected for influencing a characteristic of drilling fluid exiting a nozzle of the present invention. For example, the present invention contemplates that the geometry of any of the converging region, the throat, and the diverging region may be substantially circular, substantially elliptical, substantially oval, substantially oblong, substantially rectangular, substantially triangular, or as otherwise desired or known in the art. Accordingly, the present invention encompasses many alternative configurations.

Figure 5B:
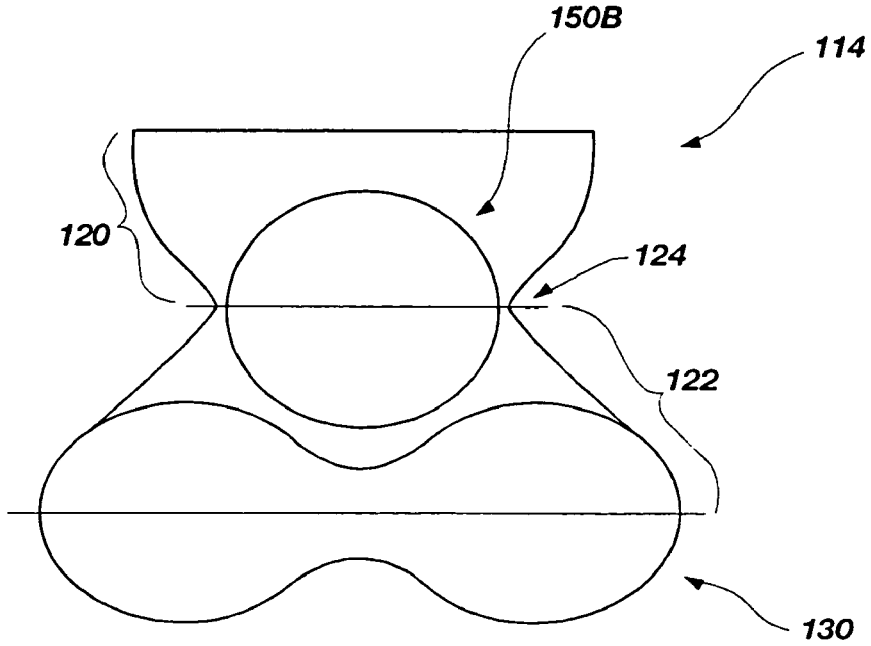

In yet a further aspect of the present invention, different shapes and orientations of converging region 120 may be employed. For example, FIG. 5A shows a substantially elliptical converging region 150A (shown proximate throat 124), wherein the major axis of the elliptical converging region 150A is oriented generally parallel to horizontal axis 103. Alternatively, a major axis of an elliptically shaped converging region 150A may be oriented at any selected angle with respect to horizontal axis 103. Such a configuration may provide desirable flow streams or jets emanating from a nozzle 28 according to the present invention. In another embodiment, as shown in FIG. 5B, converging region 150B proximate to throat 124 may comprise a substantially circular shape. Similarly, such a configuration may provide different (with respect to the converging region 150A shown in FIG. 5A), yet desirable flow streams or jets emanating from a nozzle 28 according to the present invention.

Figure 6A:
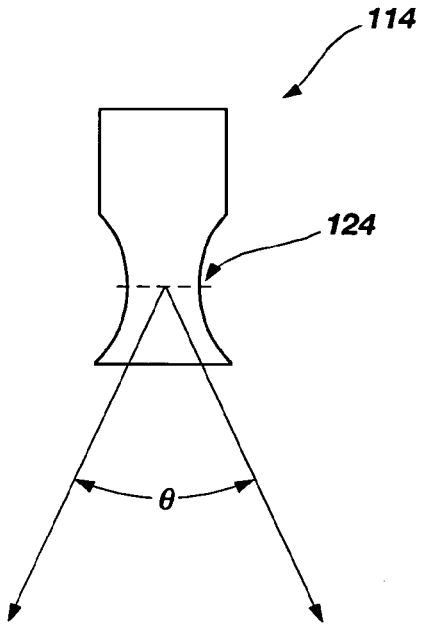
FIG. 6A shows a side view of a passageway of the present invention, showing a spread angle between anticipated, bifurcated flow streams.

As a further consideration, a so-called spread angle may be affected by the geometry of the passageway 114. As shown in FIG. 6A, spread angle θ represents the angular separation exhibited between exiting drilling fluid jets from a nozzle of the present invention. Such an angular separation may be advantageous for distributing drilling fluid within junk slots of a rotary drill bit.

Figure 6B:
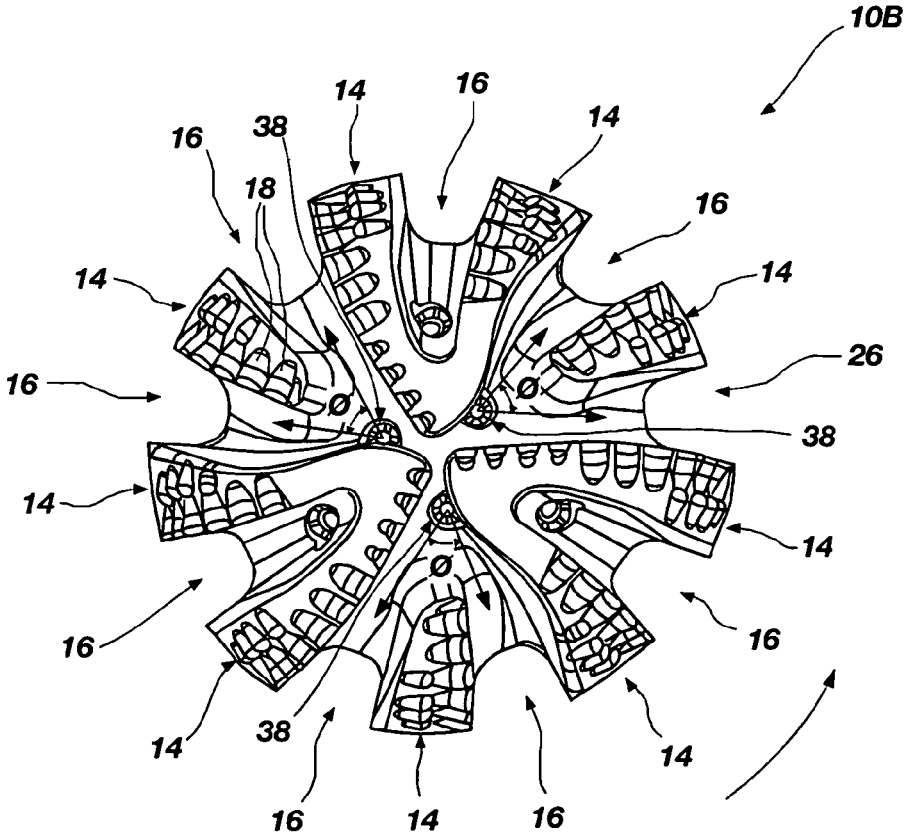
FIG. 6B shows a top elevation view of a rotary drill bit including nozzles of the present invention.
Figure 6C:
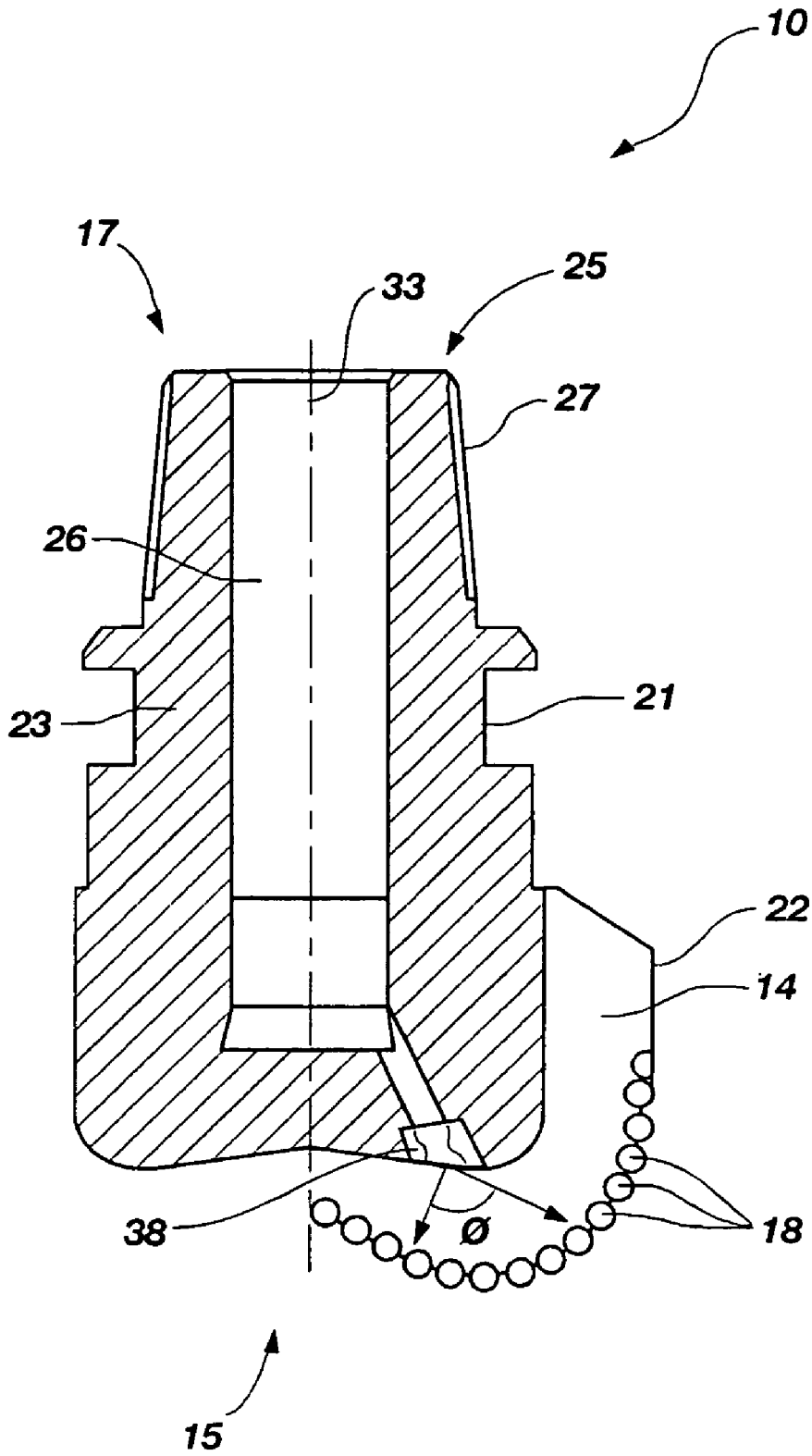
FIG. 6C shows a side cross-sectional view of a rotary drill bit similar to that of FIG. 1A showing a spread angle between anticipated, bifurcated flow streams.

For example, FIG. 6B shows a top elevation view of rotary drill bit 10B, (i.e., similar to rotary drill bit 10 as shown in FIGS. 1A and 1B) including a plurality of longitudinally extending blades 14 defining junk slots 16 therebetween. Each blade 14 may carry a plurality of cutting elements 18 thereon for cutting a subterranean formation upon rotation of the rotary drill bit 10. More particularly, nozzles 38 of the present invention are shown in three positions upon the face of the rotary drill bit 10B. Further, arrows from each of nozzles 38 represent two drilling fluid streams emanating therefrom, respectively. As may be appreciated, an angular separation (e.g., a spread angle θ, as shown in FIG. 6A) between each of the arrows from each of the nozzles 38, respectively, may be different and may be selected for providing drilling fluid to individual, circumferentially adjacent junk slots 16 without excessive erosion of the blade 14 circumferentially therebetween. In yet a further application of a nozzle of the present invention, FIG. 6C shows a rotary drill bit 10 generally as shown in FIG. 1B, wherein a nozzle 38 is affixed within a nozzle recess and spread angle θ is configured for encompassing a plurality of the cutting elements 18 positioned on blade 14. Such a configuration may be advantageous for cleaning of cuttings of a subterranean formation during use of the rotary drill bit 10.

In addition, the inventors herein have simulated different parameters regarding the geometry of a passageway and drilling fluid flow therethrough. Particularly, a so-called parametric design study has been performed with the aid of computational fluid dynamics. Thus, general observations regarding the relationship between a converging region, diverging region, and a throat of a passageway have been explored. Generally, the present invention contemplates that a position of throat 124 may be between about 10% to 50% of the overall distance between the entrance 119 of the converging region to the exit aperture 130. More specifically, positioning the throat from the exit aperture 130 toward the entrance 119 by a distance of about 20% of the overall distance between the entrance 119 of the converging region to the exit aperture 130 was found to consistently produce a maximum spread angle θ and maximum relative jet strength.

More specifically, jet strength may be quantified practically as a (normalized) measure of a maximum jet velocity generated by a fluid flow exiting a nozzle in relation to a velocity of a fluid flow at the axis of the nozzle, at a given distance along the axis of the nozzle. Such a quantification may be useful for comparison of nozzle effectiveness. For a given nozzle, a normalized jet velocity (at the axis of the nozzle) may be designated to have a magnitude of 1; therefore, the jet strength may be determined by dividing the maximum velocity of a jet by the jet velocity at the axis of the nozzle. A jet strength near 4 may imply a relatively robust jet spread with very low velocity between the two bifurcating jets or at the nozzle axis. Accordingly, a higher jet strength may imply a lower erosion for a blade positioned along the nozzle axis and in-between the bifurcated jets (see FIG. 6B).

In another geometric aspect of the present invention, orienting a major axis (elliptical, oval, oblong, or otherwise elongated) of a converging region of a passageway substantially parallel to a horizontal axis of an exit aperture may produce a greater spread angle θ. On the other hand, orienting a major axis (elliptical, oval, oblong, or otherwise elongated) of a converging region of a passageway substantially perpendicular to a horizontal axis of an exit aperture may produce a more powerful or efficient drilling fluid distribution. Further, for example, the size of enlarged conduits (at the exit aperture 130) may be about 8/32 of an inch to about 16/32 of an inch. Of course, a size of the exit aperture may be selected with respect to associated equipment for operating a rotary drill bit (e.g., pumps, mud-type, etc.). As a further consideration, a size of an area of the throat (taken substantially transverse to the flow of drilling fluid) may be between about 50% to 80% of a size of an area of the inlet (taken substantially transverse to the flow of drilling fluid). Such a configuration may provide desirable flow characteristics of drilling fluid passing through a nozzle having a passageway exhibiting at least one above-described attribute. It may be further noted that the jet spread is decreased with respect to an increasing throat area. Also, a larger throat area having an oblong shape with the minor axis (narrow) of the throat oriented perpendicular to the horizontal nozzle exit axis (labeled 103 in FIG. 5A) exhibits greater jet spread for a given throat area. Jet spread is highly related to the radial distance from the nozzle axis to the edge of the throat in the direction of the horizontal nozzle exit axis (labeled 103 in FIG. 5A).

Thus, the present invention contemplates that the direction, size, and configuration of substantially bifurcated jets, flows, or flow regimes exiting a nozzle of the present invention may be preferentially tailored for delivering drilling fluid for cleaning, cooling, or both cleaning and cooling cutting elements upon a rotary drill bit.

While certain representative embodiments and details have been shown for purposes of illustrating the invention, it will be apparent to those skilled in the art that various changes in the methods and apparatus disclosed herein may be made without departing form the scope of the invention, which is defined in the appended claims. For example, other nozzle body and passage sizes and cross-sectional shapes may be employed; and various alternative structures may be employed for attaching the nozzle body to a rotary drill bit.

The invention claimed is:

1. A nozzle for use on a rotary drill bit for forming a subterranean borehole, the nozzle comprising:

a nozzle body configured to be secured within a drill bit; and at least one fluid passageway extending through the nozzle body from an inlet to an exit aperture, the at least one fluid passageway comprising:

a converging region extending from a converging region entrance to a throat, the cross-sectional area of the at least one fluid passageway being a minimum at the throat; and a diverging region extending from the throat to an exit aperture, the cross-sectional area of the at least one fluid passageway increasing at least substantially continuously from the throat to the exit aperture, at least a portion of the diverging region of the at least one fluid passageway being at least substantially bifurcated, wherein a cross-sectional area of the at least one fluid passageway at the throat is between about fifty percent (50%) and about (80%) of a cross-sectional area of the at least one fluid passageway at the inlet.

2. The nozzle of claim 1, wherein the nozzle body comprises a ceramic or a cermet material.

3. The nozzle of claim 1, wherein the nozzle body comprises a tungsten carbide material.

4. The nozzle of claim 1, wherein the nozzle body comprises steel, at least a portion of surfaces of the nozzle body being lined with at least one of a tungsten carbide material, a diamond material, a ceramic material, a hardfacing material, or a polyurethane material.

5. The nozzle of claim 1, wherein a distance between the converging region entrance and the throat is between about ten percent (10%) and about fifty percent (50%) of a distance between the converging region entrance and the exit aperture.

6. The nozzle of claim 5, wherein a distance between the converging region entrance and the throat is about twenty percent (20%) of a distance between the converging region entrance and the exit aperture.

7. The nozzle of claim 5, wherein the throat is at least substantially centered between the converging region entrance and the exit aperture.

8. The nozzle of claim 1, further comprising an inlet region extending between the inlet and the converging region entrance, a portion of the at least one fluid passageway extending through the inlet region between the inlet and the converging region entrance.

9. The nozzle of claim 8, wherein the cross-sectional area of the at least one fluid passageway is at least substantially constant through the inlet region.

10. The nozzle of claim 1, wherein at least a portion of the converging region is at least substantially bifurcated.

11. The nozzle of claim 1, wherein the cross-sectional area of the at least one fluid passageway at the throat has an oblong shape.

12. The nozzle of claim 11, wherein the oblong shape can be derived from two partially overlapping circles.

13. The nozzle of claim 12, wherein each of the two partially overlapping circles has a diameter between about one-fourth (¼) of an inch to about one-half (½) of an inch.

14. The nozzle of claim 1, wherein the at least substantially bifurcated portion of the diverging region of the at least one fluid passageway comprises:

a first enlarged conduit; and a second enlarged conduit.

15. The nozzle of claim 14, wherein each of the first enlarged conduit and the second enlarged conduit has a cross-sectional area having a shape that is at least substantially circular or at least substantially oval.

16. The nozzle of claim 14, wherein the first enlarged conduit and the second enlarged conduit are at least substantially asymmetric through at least a portion of the diverging region of the at least one fluid passageway.

17. The nozzle of claim 14, wherein the first enlarged conduit and the second enlarged conduit each have a diameter that varies between the throat and the exit aperture, the diameter of the second enlarged conduit being equal to the diameter of the first enlarged conduit at all points between the throat and the exit aperture.

18. The nozzle of claim 14, wherein the first enlarged conduit and the second enlarged conduit each have a diameter that varies between the throat and the exit aperture, the diameter of the second enlarged conduit differing from the diameter of the first enlarged conduit through at least a portion of the diverging region of the at least one fluid passageway.

19. The nozzle of claim 14, further comprising a narrow conduit providing fluid communication between the first enlarged conduit and the second enlarged conduit.

20. The nozzle of claim 19, wherein the narrow conduit is at least partially defined by at least one flow separation feature integrally formed with the nozzle body and positioned between the first enlarged conduit and the second enlarged conduit.

21. The nozzle of claim 20, wherein the at least one flow separation feature comprises two flow separation features integrally formed with the nozzle body and positioned between the first enlarged conduit and the second enlarged conduit.

22. The nozzle of claim 21, wherein each of the two flow separation features comprises a smooth radius or fillet extending between the first enlarged conduit and the second enlarged conduit.

23. The nozzle of claim 21, wherein the two flow separation features are separated from one another by an average distance of less than about one-half (½) of an inch.

24. The nozzle of claim 14, wherein the first enlarged conduit is configured to direct a fluid flowing therethrough out from the exit aperture in a first general direction, and wherein the second enlarged conduit is configured to direct a fluid flowing therethrough out from the exit aperture in a second general direction that is oriented at an angle relative to the first general direction.

25. A rotary drill bit for forming a borehole in a subterranean formation, comprising:

a bit body having a face;

at least one cutting element mounted on the face of the bit body; and at least one nozzle installed within the bit body and configured for communicating drilling fluid from an interior thereof to the face of the bit body, the at least one nozzle comprising:

a nozzle body; and at least one fluid passageway extending through the nozzle body from an inlet to an exit aperture, the at least one fluid passageway comprising:

a converging region extending from a converging region entrance to a throat, the cross-sectional area of the at least one fluid passageway being a minimum at the throat; and a diverging region extending from the throat to an exit aperture, the cross-sectional area of the at least one fluid passageway increasing at least substantially continuously from the throat to the exit aperture, at least a portion of the diverging region of the at least one fluid passageway being at least substantially bifurcated; wherein a cross-sectional area of the at least one fluid passageway at the throat is between about fifty percent (50%) and about (80%) of a cross-sectional area of the at least one fluid passageway at the inlet.

26. The rotary drill bit of claim 25, wherein the nozzle body comprises a ceramic or a cermet material.

27. The rotary drill bit of claim 25, wherein the nozzle body comprises a tungsten carbide material.

28. The rotary drill bit of claim 25, wherein the nozzle body comprises steel, at least a portion of the surfaces of the nozzle body being lined with at least one of a tungsten carbide material, a diamond material, a ceramic material, a hardfacing material, or a polyurethane material.

29. The rotary drill bit of claim 25, wherein a distance between the converging region entrance and the throat is between about ten percent (10%) and about fifty percent (50%) of a distance between the converging region entrance and the exit aperture.

30. The rotary drill bit of claim 29, wherein a distance between the converging region entrance and the throat is about twenty percent (20%) of a distance between the converging region entrance and the exit aperture.

31. The rotary drill bit of claim 29, wherein the throat is at least substantially centered between the converging region entrance and the exit aperture.

32. The rotary drill bit of claim 25, further comprising an inlet region extending between the inlet and the converging region entrance, a portion of the at least one fluid passageway extending through the inlet region between the inlet and the converging region entrance.

33. The rotary drill bit of claim 32, wherein the cross-sectional area of the at least one fluid passageway is at least substantially constant through the inlet region.

34. The rotary drill bit of claim 25, wherein at least a portion of the converging region is at least substantially bifurcated.

35. The rotary drill bit of claim 25, wherein the cross-sectional area of the at least one fluid passageway at the throat has an oblong shape.

36. The rotary drill bit of claim 35, wherein the oblong shape can be derived from two partially overlapping circles.

37. The rotary drill bit of claim 36, wherein each of the two partially overlapping circles has a diameter between about one-fourth (¼) of an inch to about one-half (½) of an inch.

38. The rotary drill bit of claim 25, wherein the at least substantially bifurcated portion of the diverging region of the at least one fluid passageway comprises:

a first enlarged conduit; and a second enlarged conduit.

39. The rotary drill bit of claim 38, wherein each of the first enlarged conduit and the second enlarged conduit has a cross-sectional area having a shape that is at least substantially circular or at least substantially oval.

40. The rotary drill bit of claim 38, wherein the first enlarged conduit and the second enlarged conduit are at least substantially asymmetric through at least a portion of the diverging region of the at least one fluid passageway.

41. The rotary drill bit of claim 38, wherein the first enlarged conduit and the second enlarged conduit each have a diameter that varies between the throat and the exit aperture, the diameter of the second enlarged conduit being equal to the diameter of the first enlarged conduit at all points between the throat and the exit aperture.

42. The rotary drill bit of claim 38, wherein the first enlarged conduit and the second enlarged conduit each have a diameter that varies between the throat and the exit aperture, the diameter of the second enlarged conduit differing from the diameter of the first enlarged conduit through at least a portion of the diverging region of the at least one fluid passageway.

43. The rotary drill bit of claim 38, further comprising a narrow conduit providing fluid communication between the first enlarged conduit and the second enlarged conduit.

44. The rotary drill bit of claim 43, wherein the narrow conduit is at least partially defined by at least one flow separation feature integrally formed with the nozzle body and positioned between the first enlarged conduit and the second enlarged conduit.

45. The rotary drill bit of claim 44, wherein the at least one flow separation feature comprises two flow separation features integrally formed with the nozzle body and positioned between the first enlarged conduit and the second enlarged conduit.

46. The rotary drill bit of claim 45, wherein each of the two flow separation features comprises a smooth radius or fillet extending between the first enlarged conduit and the second enlarged conduit.

47. The rotary drill bit of claim 45, wherein the two flow separation features are separated from one another by an average distance of less than about one-half (½) of an inch.

48. The rotary drill bit of claim 38, wherein the first enlarged conduit is configured to direct a fluid flowing therethrough out from the exit aperture in a first general direction, and wherein the second enlarged conduit is configured to direct a fluid flowing therethrough out from the exit aperture in a second general direction that is oriented at an angle relative to the first general direction.

49. The rotary drill bit of claim 25, wherein the bit body comprises a plurality of longitudinally extending blades defining junk slots therebetween, and wherein the at least one cutting element mounted on the face of the bit body comprises a plurality of cutting elements, each longitudinally extending blade having a plurality of cutting elements thereon.

50. The rotary drill bit of claim 49, wherein the at least one nozzle is configured to direct a first stream of fluid in a first general direction towards a first junk slot and to direct a second stream of fluid in a second general direction towards a second junk slot.

51. The rotary drill bit of claim 49, wherein the at least one nozzle is configured to direct a stream of fluid out from the exit aperture in a spread angle, the spread angle encompassing a plurality of cutting elements on a longitudinally extending blade.

52. The rotary drill bit of claim 25, further comprising an orientation feature on at least one of the bit body and the at least one nozzle, the orientation feature configured to indicate an orientation of the nozzle with respect to the bit body.

53. The rotary drill bit of claim 52, wherein the orientation feature comprises a mark on the at least one nozzle.

54. The rotary drill bit of claim 25, wherein the bit body includes at least one nozzle recess, the at least one nozzle being at least partially disposed within the nole recess.

55. The rotary drill bit of claim 54, wherein the at least one nozzle includes a threaded surface engaged with a complementary threaded surface formed on the bit body within the at least one nozzle recess.

56. The rotary drill bit of claim 54, further comprising a retaining ring attached to the bit body and configured to secure the at least one nozzle to the bit body.

* * * * *

UNITED STATES PATENT AND TRADEMARK OFFICE

CERTIFICATE OF CORRECTION

PATENT NO. : 7,481,284 B2
APPLICATION NO. : 11/336415
DATED : January 27, 2009
INVENTOR(S) : Michael R. Wells and Chad J. Beuershausen It is certified that error appears in the above-identified patent and that said Letters Patent is hereby corrected as shown below:

In the Claims:

CLAIM 54, COLUMN 16, LINE 17, change "nole" to --nozzle--

Signed and Sealed this
Twenty-first Day of May, 2013

Teresa Stanek Rea
*Acting Director of the United States Patent and Trademark Office*